US005556289A

United States Patent [19]

Holbrook, Jr.

[11] Patent Number: 5,556,289

[45] Date of Patent: Sep. 17, 1996

[54] SAFETY COVER FOR AN ELECTRICAL OUTLET

[76] Inventor: Ira C. Holbrook, Jr., 365 Cherry Hill Rd., Elkton, Md. 21921

[21] Appl. No.: 371,526

[22] Filed: Jan. 17, 1995

[51] Int. Cl.[6] ..... H01R 13/44

[52] U.S. Cl. ..... 439/135; 439/142; 174/67

[58] Field of Search ..... 439/135, 136, 439/144, 535, 536

[56] References Cited

U.S. PATENT DOCUMENTS

| | | | |
|---|---|---|---|
| 2,916,733 | 12/1959 | Hirsch | 439/136 |
| 4,530,555 | 7/1985 | South | 439/135 |
| 5,045,640 | 9/1991 | Riceman | 439/144 |
| 5,174,773 | 12/1992 | Jones | 439/144 |
| 5,178,551 | 1/1993 | Bach | 439/135 |
| 5,389,740 | 2/1995 | Austin | 439/144 |

*Primary Examiner*—David L. Pirlot
*Assistant Examiner*—Adesh Bhargava

[57] ABSTRACT

A safety cover for an electrical outlet including a hollow rigid container having a back wall with a periphery extended outwards therefrom and thereby defining a hollow interior, an opening to the interior, and a rim bounding the opening, the back wall further including a plurality of socket holes and a screw hole formed thereon and with the socket holes and screw hole alignable with a screw hole and corresponding socket plugs of an electrical receptacle; a rigid lid positionable over the opening of the container in contact with the rim, the lid further having a plurality of plug holes formed thereon and with each plug hole separately alignable with a socket hole of the back wall of the container; and a plurality of rigid doors with each door positionable within a plug hole of the lid and thereby creating a through hole for receipt of an electrical cord; and a coupling mechanism for removably coupling each door within a separate plug hole of the lid.

1 Claim, 4 Drawing Sheets

PRIOR ART

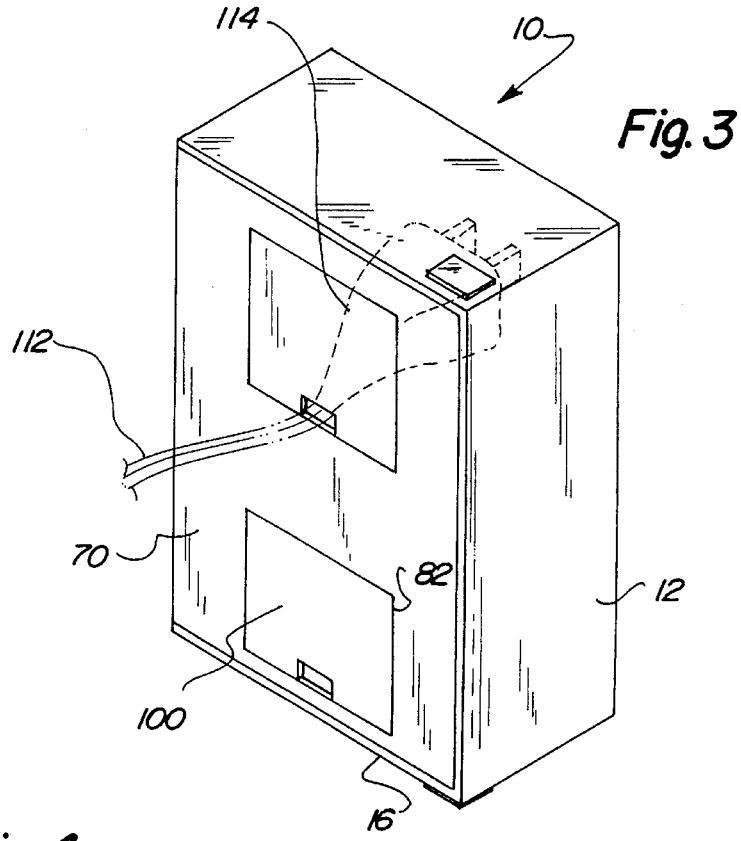
Fig. 3
Fig. 4
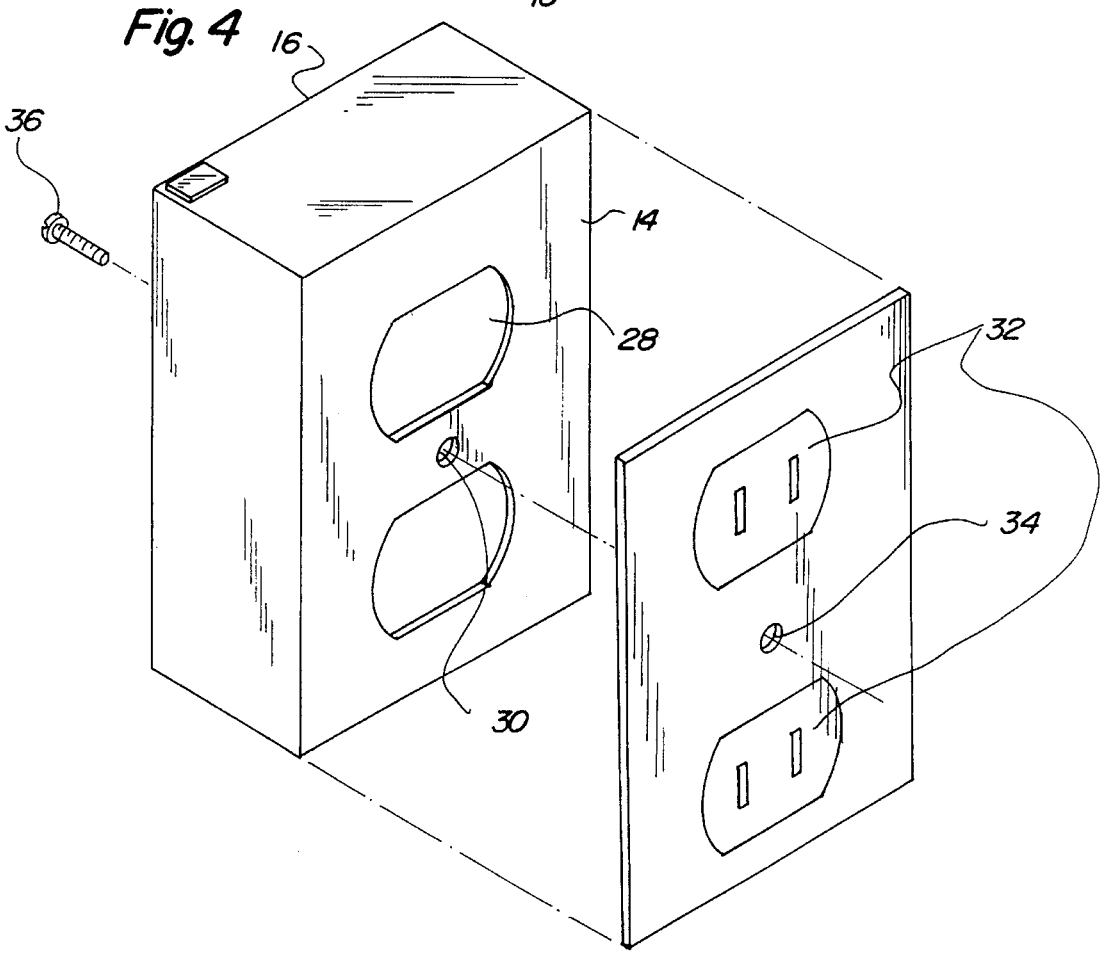

SAFETY COVER FOR AN ELECTRICAL OUTLET

BACKGROUND OF THE INVENTION

1. Field of the Invention

The present invention relates to a safety cover for an electrical outlet and more particularly pertains to preventing unauthorized access to an electrical socket and thereby precluding possible electrical shock with a safety cover for an electrical outlet.

2. Description of the Prior Art

The use of safety covers is known in the prior art. More specifically, safety covers heretofore devised and utilized for the purpose of preventing access to an electrical outlet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,078,614 to Shotey discloses a sliding cover and shroud for electrical outlets. U.S. Pat. No. 5,106,314 to Bael discloses a safety cover for electrical outlets. U.S. Pat. No. 5,195,901 to Correnti discloses an electrical outlet safety cover. U.S. Pat. No. 5,198,618 to Shieh discloses a safety cover plate for an electrical socket. U.S. Pat. No. 5,297,973 to Gorman discloses a safety electrical connection apparatus.

While these devices fulfill their respective, particular objective and requirements, the aforementioned patents do not describe a safety cover for an electrical outlet that prevents direct access to an electrical receptacle in operation with an electrical device coupled thereto to thereby prevent the possibility of electrical shock, especially to children.

In this respect, the safety cover for an electrical outlet according to the present invention substantially departs from the conventional concepts and designs of the prior art, and in doing so provides an apparatus primarily developed for the purpose of preventing unauthorized access to an electrical socket and thereby precluding possible electrical shock.

Therefore, it can be appreciated that there exists a continuing need for new and improved safety cover for an electrical outlet which can be used for preventing unauthorized access to an electrical socket and thereby precluding possible electrical shock. In this regard, the present invention substantially fulfills this need.

SUMMARY OF THE INVENTION

In the view of the foregoing disadvantages inherent in the known types of safety covers now present in the prior art, the present invention provides an improved safety cover for an electrical outlet. As such, the general purpose of the present invention, which will be described subsequently in greater detail, is to provide a new and improved safety cover for an electrical outlet and method which has all the advantages of the prior art and none of the disadvantages.

To attain this, the present invention essentially comprises, in combination, a rectangular box-shaped rigid plastic container having a back wall with a periphery extended outwards therefrom and thereby defining a hollow interior, an opening to the interior, and a rim bounding the opening and with the periphery formed of a planar rectangular short top wall, a planar rectangular short bottom wall, and a pair of planar rectangular long side walls extended therebetween. Each wall has an interior surface and an exterior surface. The back wall includes a pair of socket holes formed thereon and a screw hole disposed thereon between the socket holes and with the socket holes and screw holes alignable with a pair of sockets plugs and a screw hole of an electrical receptacle. Each short wall further includes a through hole disposed thereon at a location adjacent to the rim and one of the long walls and with both of the through holes aligned about a common vertical axis. One of the long walls includes an upper pair of horizontal spaced tabs and a lower pair of horizontal spaced tabs with each tab extended inwards from the interior surface of the long wall towards the interior. Each of the tabs has a through hole disposed thereon and with the through holes of the tabs aligned along the same common vertical axis as the through holes on the short walls.

A metal latch is provided and includes an upper rod, a lower rod, an upper spring, and a lower spring. The upper rod has a head end and a bifurcated tip end. The tip end of the upper rod has a coupling hole disposed therethrough. The lower rod has a head end and a flattened tip end. The tip end of the lower rod has a coupling hole disposed therethrough. The upper rod is slidably received within the through hole of the top wall and the through holes of the upper tabs with its head end positioned adjacent to the exterior surface of the top wall and with its tip end positioned directly below the upper pair of tabs. The lower rod is slidably received within the through hole of the bottom wall and within the through holes of the lower tabs with its head end positioned adjacent to the exterior surface of the bottom wall and its tip end positioned directly above the lower tabs facing the tip end of the upper rod for slidable insertion therein. The upper spring is separately disposed about the upper rod between the interior surface of the top wall and the nearest tab of the upper pair. The lower spring is separately disposed about the lower rod between the interior surface of the bottom wall and the nearest tab of the lower pair. The head ends of the rods are inwardly depressible for urging the tip ends of the rods together such that their coupling holes are aligned about a common horizontal axis. The head ends are further releasable for allowing the springs to urge the tip ends of the rods apart.

A rectangular planar rigid plastic lid is included and has an exterior surface, an interior surface, and a periphery interconnecting the surfaces formed of a pair of short edges with a pair of long edges extended therebetween. The lid is hingably coupled to the long wall of the container remote from the tabs. The lid is positionable over the opening of the container such that the exterior surface thereof is located flush with the rim. The lid further includes a pair of rectangular plug holes formed thereon. Each plug hole is separately alignable with a socket hole of the back wall of the container about a common axis of symmetry when the lid is closed. The lid includes two sets of plastic clips with each set including four clips and with each clip of a set integral with the interior surface near a separate corner of each plug hole. The lid additionally includes a peg coupled to and extended outwards from the interior surface. The peg has a base end, a tip end, and an intermediate necked portion therebetween and with the necked portion disposable within aligned coupling holes of the rods of the latch when the head ends are depressed and securable therebetween when the head ends are released.

Lastly, a pair of rectangular planar rigid plastic doors are provided. Each door has an exterior surface, an interior surface, and a periphery formed of a top edge with a long upper lip formed therealong, a bottom edge with a short lower lip formed thereon, and a pair of side edges extended therebetween. Each door is snapidly removably coupled within a separate plug hole of the lid with the upper lip engaged with an upper pair of clips and the lower lip engaged with a lower pair of clips. Each door further includes a rectangular cut out formed on the midpoint of the bottom edge thereof and with the cut outs on the doors defining a pair of egress holes when the doors are snapidly coupled to the lid. Each egress hole is adapted to receive an electrical cord of an electrical plug disposed within the interior of the container through one of the corresponding plug holes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety cover for an electrical outlet which has all the advantages of the prior art safety covers and none of the disadvantages.

It is another object of the present invention to provide a new and improved safety cover for an electrical outlet which may be easily and efficiently manufactured and marketed.

It is a further object of the present invention to provide a new and improved safety cover for an electrical outlet which is of durable and reliable construction.

An even further object of the present invention is to provide a new and improved safety cover for an electrical outlet which is susceptible of a low cost of manufacture with regard to both materials and labor, and which accordingly is then susceptible of low prices of sale to the consuming public, thereby making such a safety cover for an electrical outlet economically available to the buying public.

Still yet another object of the present invention is to provide a new and improved safety cover for an electrical outlet which provides in the apparatuses and methods of the prior art some of the advantages thereof, while simultaneously overcoming some of the disadvantages normally associated therewith.

Even still another object of the present invention is to provide a new and improved safety cover for an electrical outlet for preventing unauthorized access to an electrical socket and thereby precluding possible electrical shock.

Lastly, it is an object of the present invention to provide a new and improved safety cover for an electrical outlet comprising a hollow rigid container having a back wall with a periphery extended outwards therefrom and thereby defining a hollow interior, an opening to the interior, and a rim bounding the opening, the back wall further including a plurality of socket holes and a screw hole formed thereon and with the socket holes and screw hole alignable with a screw hole and corresponding socket plugs of an electrical receptacle; a rigid lid positionable over the opening of the container in contact with the rim, the lid further having a plurality of plug holes formed thereon and with each plug hole separately alignable with a socket hole of the back wall of the container; a plurality of rigid doors with each door positionable within a plug hole of the lid and thereby creating a through hole for receipt of an electrical cord; and coupling means for removably coupling each door within a separate plug hole of the lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front perspective view of the preferred embodiment constructed in accordance with the principles of the present invention.

FIG. 4 is a rear perspective view of the preferred embodiment of the present invention.

The same reference numerals refer to the same parts through the various Figures.

DESCRIPTION OF THE PREFERRED EMBODIMENT

Figure 1:
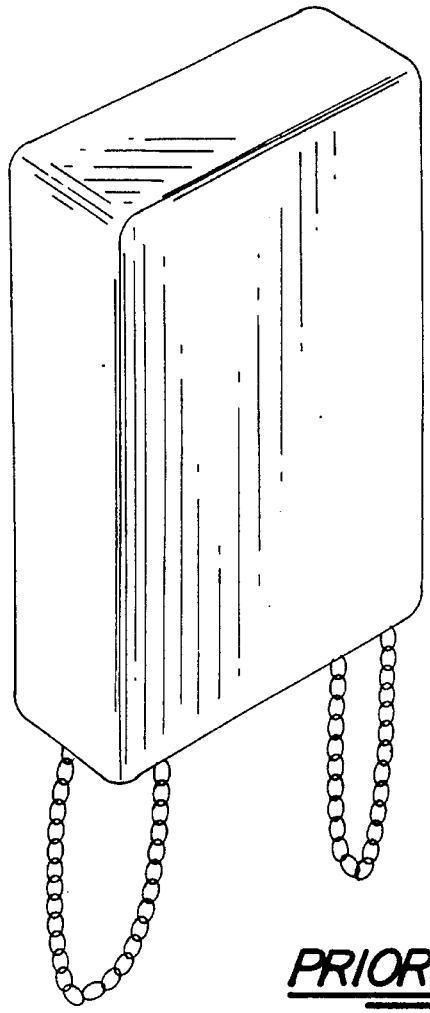
FIG. 1 is a perspective view of a prior art sliding cover and shroud for electrical outlets.
Figure 2:
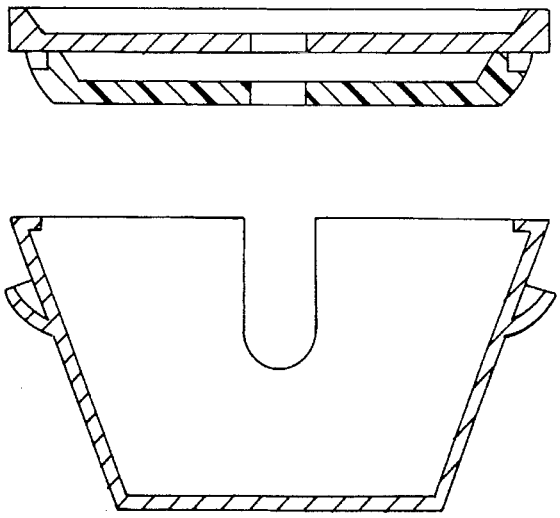
PRIOR ART Fig. 2
FIG. 2 is a cross-sectional view of a prior art electrical outlet safety cover.

With reference now to the drawings, the preferred embodiment of the new and improved safety cover for an electrical outlet embodying the principles and concepts of the present invention and generally designated by the reference number 10 will be described.

The present invention is comprised of a plurality of components. In their broadest context, such components include a container, latch, lid, and doors. Such components are individually configured and correlated with respect to each other to provide the intended function of preventing unauthorized access to an electrical socket and thereby precluding possible electrical shock.

Specifically, the present invention includes a container 12 as shown in FIG. 3. The container is rectangular and box-shaped in structure. It is formed of a rigid non-conductive material such as plastic. The container has a planar back wall 14 with a periphery extended outwards therefrom and thereby defining a hollow interior, a generally rectangular opening to the interior, and a rectangular rim 16 bounding the opening. The periphery is formed of a planar rectangular short top wall 18, a planar rectangular short bottom wall 20 and a pair of opposed planar rectangular long side walls 22 extended therebetween. Each wall has an interior surface 24 and an exterior surface 26. The back wall further includes a pair of socket holes 28 formed thereon and a circular screw hole 30 disposed thereon between the socket holes. The periphery of each socket hole has a straight top edge, a straight bottom edge, and a pair of outwardly curved side edges therebetween. The socket holes and screw holes are alignable for receiving a pair of socket plugs 32 and a screw hole 34 of an electrical receptacle as shown in FIG. 4. A screw 36 is then used for coupling the back wall of the container to the electrical receptacle such that the socket plugs 32 are projected within the interior.

Figure 5:
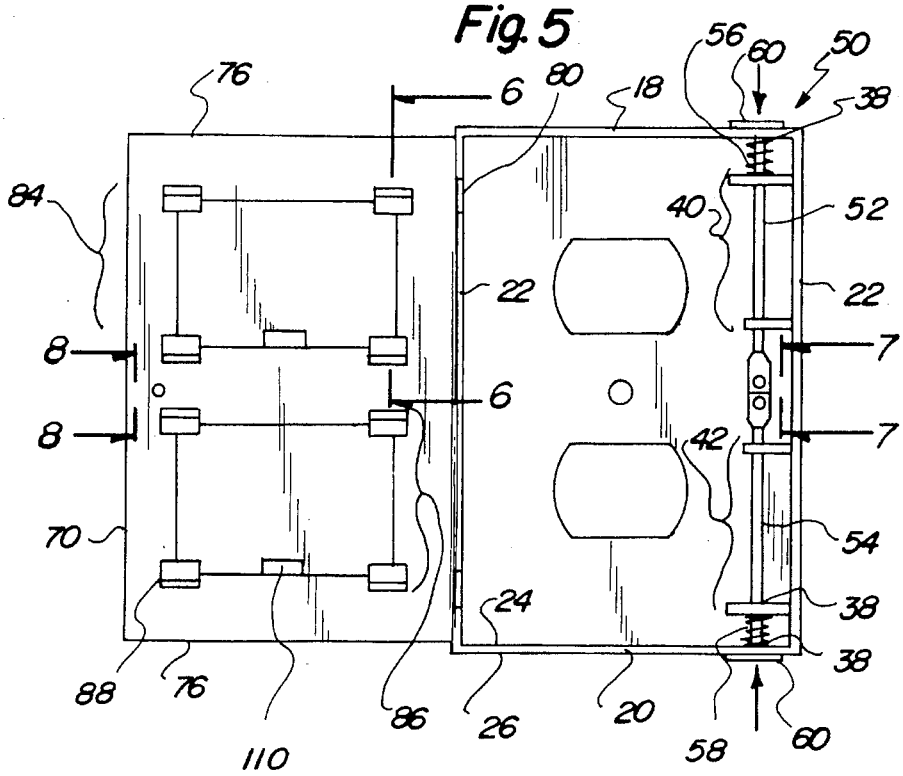
FIG. 5 is a side-elevational view of the preferred embodiment with its lid opened for allowing access therein.

Each short wall of the container further includes a circular through hole 38 disposed thereon at a location adjacent to the rim 16 and one of the long walls 22 as best illustrated in FIG. 5. Both of the through holes are aligned about a common vertical axis. One of the long walls includes an upper pair of generally rectangular planar horizontal spaced tabs 40 and a lower pair of rectangular planar horizontal spaced tabs 42. Each tab is extended inwards from the interior surface of the long wall towards the interior. Each of the tabs has a circular through hole 38 disposed thereon. The through holes of the tabs are aligned about the same common axis and are the same size as the through holes on the short walls.

A latch 50 is also provided. The latch is formed of metal or other similar rigid material. The latch includes an upper rod 52, a lower rod 54, an upper spring 56, and a lower spring 58. The upper rod has a rectangular head end 50, a bifurcated tip end 62 with a circular coupling hole 64 disposed therethrough, and an intermediate cylindrical portion therebetween. The lower rod has a rectangular head end 60, a flattened tip end 62 with a circular coupling hole 64 disposed therethrough, and an intermediate cylindrical portion extended therebetween. The upper rod is slidably received within the through hole of the top wall 18 and the through holes of the upper tabs 40 with its head positioned adjacent to the exterior surface of the top wall and with its tip end positioned directly below the upper pair of tabs 40 within the interior. The lower rod is slidably received within the through hole of the bottom wall 20 and within the through holes of the lower tabs 42 with its head end positioned adjacent to the exterior surface of the bottom wall and its tip end positioned directly above the lower tabs 42 within the interior and facing the tip end 62 of the upper rod for slidable insertion therein. The upper spring 56 is separately disposed about the upper rod 52 between the interior surface of the top wall and the nearest tab of the upper pair. The lower spring 58 is separately disposed about the lower rod 54 between the interior surface of the bottom wall and the nearest tab of the lower pair. The springs are sufficiently resilient to keep the tip ends of the rods apart when placed in an unbiased position. The head ends 60 of the rods are inwardly depressible for biasing the springs and urging the tip ends 62, 68 of the rods together such that their coupling holes 64 are aligned about a common horizontal axis. The head ends are releasable for allowing the springs to urge the tip ends of the rods apart.

Figure 8:
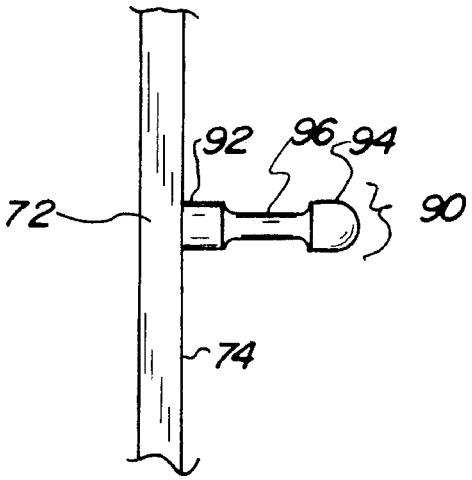
FIG. 8 is a view of the present invention taken along the line 8—8 of FIG. 5.

Also included as part of the present invention is a lid 70. The lid is rectangular and planar in structure. It is formed of a non-conductive rigid material such as plastic. The lid has an exterior surface 72, an interior surface 74, and a periphery interconnecting the surfaces. The periphery is formed of a pair of short edges 76 with a pair of long edges 78 extended therebetween. The lid is coupled to the long wall of the container remote from the tabs 40, 42 with a metal hinge 80. The lid is positionable over the opening of the container such that the exterior surface thereof is located flush with the rim as shown in FIG. 3. The lid further has a pair of rectangular plug holes 82 formed thereon. Each plug hole has a periphery formed of a long top edge, a long bottom edge, and a pair of short side edges extended therebetween. Each plug hole is separately alignable with a socket hole 28 of the back wall of the container about a common axis of symmetry when the lid is closed. This allows an external electrical plug to be inserted through a plug hole 82 to the interior for coupling with a corresponding socket plug of an electrical receptacle positioned within a socket hole 28 as shown in FIG. 3. The lid also includes two sets of generally resilient clips 84, 86. The clips are formed of a non-conductive material such as plastic. Each set includes four clips. Each clip 88 of a set is integral with the interior surface of the lid and positioned near a separate corner of each plug hole 82 as shown in FIG. 5. The lid additionally includes a peg 90 coupled to and extended outwards from the interior surface of the lid as best illustrated in FIG. 8. The peg has a base end 92, a tip end 94 and an intermediate necked portion therebetween. The necked portion is disposable within aligned coupling holes 64 of the rods of the latch 50 when the head ends 60 are depressed. Furthermore, the necked portion is securable between the tip ends of the rods when the head ends are released to the unbiased position. The latch mechanism and peg combination is thus designed to preclude it from being actuated by children, since most children cannot readily simultaneously depress the heads of the rods for releasing the peg.

Figure 6:
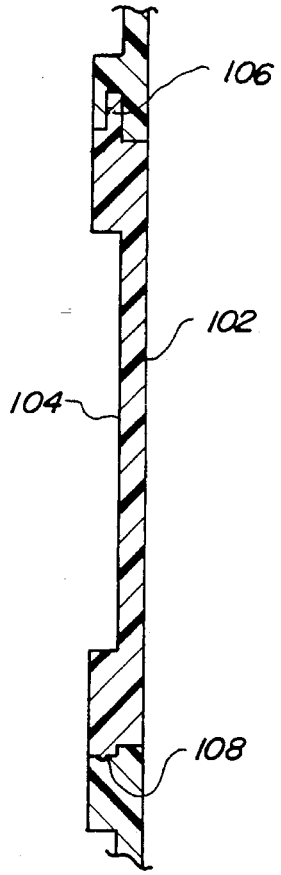
FIG. 6 is a cross-sectional view of the present invention taken along the line 6—6 of FIG. 5.
Figure 7:
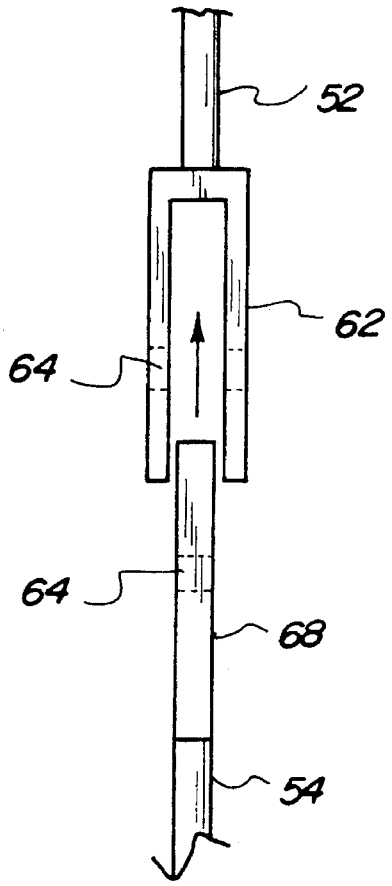
FIG. 7 is a view of the present invention taken along the line 7—7 of FIG. 5.

Lastly, the present invention includes a pair of doors 100. Each door is rectangular and planar in structure. Each door is further formed of a non-conductive rigid material such as plastic. Each door has an exterior surface 102, an interior surface 104, and a periphery interconnecting the surfaces. The periphery is formed of a top edge with a long upper lip 106 formed therealong, a bottom edge with a short lower lip 108 formed thereon, and a pair of side edges extended therebetween. The long upper lip and short lower lip are best illustrated in FIG. 6. Each door is snapidly removably coupled within a separate plug hole 82 of the lid with the upper lip 106 engaged with an upper pair of clips of one set and with the lower lip 108 engaged with a lower pair of clips of the same set. This type of door coupling is readily de-coupleable by adults but uncoupleable by children, thereby preventing their access to the interior of the container. Each door further has a rectangular cut out 110 formed at the midpoint of the bottom edge of each door. The cut outs of the doors define a pair of egress holes when the doors are secured to the lid. Each egress hole is adapted to receive an electrical cord 112 of an electrical plug 114 disposed within the interior of the container through one of the corresponding plug holes 82 as best illustrated in FIG. 3. With an electrical plug connected to a receptacle, the container sealed with a door, and the cord of the plug extended outwardly from the corresponding egress hole, unauthorized access is prevented to the electrical plug, thereby precluding possible electrical shock, especially to young children.

The present invention is a safety device which is placed over electrical wall outlets to prevent cords and plugs from becoming accidentally removed. The present invention fits over an existing electrical wall outlet. It consists of two outlet holes within the back and a small center hole in which a screw is inserted for attachment to the wall unit. A hinged front lid has two outlet holes which include small replaceable doors. Two small slots are located on the bottom edge of each of the doors and are large enough to accommodate an electrical cord. The lid is opened by a locking system located on the top and bottom corners of the container. The present invention is produced from plastic and can be manufactured in a variety of colors and designs. The present invention is designed to replace existing wall outlet coverings. To connect a plug into the outlet, the user simply slides the plug through a front plug socket and into the desired outlet. The small door is then replaced, and the electrical cord of the plug is fitted through the bottom slot. If the second outlet is not to be used, the remaining door is capped, completely enclosing the electrical outlet. To remove the cord, the upper and lower buttons are simultaneously pressed inward, releasing the cover and exposing the outlet. The present invention prevents small children from disconnecting electrical cords from the wall outlets and eliminates the electrical danger of exposed cords partially removed from an electrical outlet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A safety cover for an electrical outlet for preventing unauthorized access to an electrical socket and thereby precluding possible electrical shock comprising, in combination:

a rectangular box-shaped rigid plastic container having a back wall with a periphery extended outwards therefrom and thereby defining a hollow interior, an opening to the interior, and a rim bounding the opening and with the periphery formed of a planar rectangular short top wall, a planar rectangular short bottom wall, and a pair of planar rectangular long side walls extended therebetween, each wall having an interior surface and an exterior surface, the back wall including a pair of socket holes formed thereon with each socket hole having a top edge, a bottom straight edge, and a pair of outwardly curved side edges therebetween, the back wall further including a screw hole disposed thereon between the socket holes and with the socket holes and screw holes alignable with a pair of sockets plugs and a screw hole of an electrical receptacle, wherein a screw may be use for coupling the back wall of the container to the electrical receptacle such that the socket plugs are projected within the interior, each short wall further including a through hole disposed thereon at a location adjacent to the rim and one of the long walls and with both of the through holes aligned about a common vertical axis, one of the long walls including an upper pair of horizontal spaced tabs and a lower pair of horizontal spaced tabs with each tab extended inwards from the interior surface of the long wall towards the interior, each of the tabs having a through hole disposed thereon and with the through holes of the tabs aligned along the same common vertical axis as the through holes on the short walls;

a metal latch including an upper rod, a lower rod, an upper spring, and a lower spring, the upper rod having a rectangular head end, a cylindrical intermediate portion, and a bifurcated tip end with a coupling hole disposed therethrough, the lower rod having a head end and a flattened tip end with a coupling hole disposed therethrough, the upper rod slidably received within the through hole of the top wall and the through holes of the upper tabs with its head end positioned adjacent to the exterior surface of the top wall and with its tip end positioned directly below the upper pair of tabs, the lower rod slidably received within the through hole of the bottom wall and within the through holes of the lower tabs with its head end positioned adjacent the exterior surface of the bottom wall and its tip end positioned directly above the lower tabs facing the tip end of the upper rod for slidable insertion therein, the upper spring separately disposed about the upper rod between the interior surface of the top wall and the nearest tab of the upper pair, the lower spring separately disposed about the lower rod between the interior surface of the bottom wall and the nearest tab of the lower pair, the head ends of the rods inwardly depressible for urging the tip ends of the rods together such that their coupling holes are aligned about a common horizontal axis and with the head ends releasable for allowing the springs to urge the tip ends of the rods apart;

a rectangular planar rigid plastic lid having an exterior surface, an interior surface, and a periphery interconnecting the surfaces formed of a pair of short edges with a pair of long edges extended therebetween, the lid hingably coupled to the long wall of the container remote from the tabs and with the lid positionable over the opening of the container such that the exterior surface thereof is located flush with the rim, the lid further having a pair of rectangular plug holes formed thereon, each plug hole separately alignable with a socket hole of the back wall of the container about a common axis of symmetry when the lid is closed, the lid including two sets of plastic clips with each set including four clips and with each clip of a set integral with the interior surface near a separate corner of each plug hole, the lid additionally including a peg coupled to and extended outwards from the interior surface and with the peg having a base end, a tip end, and an intermediate necked portion therebetween and with the necked portion disposable within aligned coupling holes of the rods of the latch when the head ends are depressed and securable therebetween when the head ends are released, wherein the latch mechanism and peg combination is designed to preclude the latching mechanism from being actuated by children; and a pair of rectangular planar rigid plastic doors for precluding any possibility of inward infiltration with each door having an exterior surface, an interior surface, and a periphery formed of a top edge with a long upper lip formed therealong, a bottom edge with a short lower lip formed thereon, and a pair of side edges extended therebetween, each door snapidly removably coupled within a separate plug hole of the lid with the upper lip engaged with an upper pair of clips and the lower lip engaged with a lower pair of clips, each door further having a rectangular cut out formed on the midpoint of the bottom edge thereof and with the cut outs on the doors defining a pair of egress holes when the doors are snapidly coupled to the lid, each egress hole adapted to receive an electrical cord of an electrical plug disposed within the interior of the container through one of the corresponding plug holes.

* * * * *